United States Patent [19]

Yoshida et al.

[11] Patent Number: 4,482,031

[45] Date of Patent: Nov. 13, 1984

[54] AC ELEVATOR CONTROL APPARATUS

[75] Inventors: Masayuki Yoshida; Masami Nomura; Hiroyuki Ikejima, all of Aichi, Japan

[73] Assignee: Mitsubishi Denki Kabushiki Kaisha, Tokyo, Japan

[21] Appl. No.: 472,461

[22] Filed: Mar. 7, 1983

[30] Foreign Application Priority Data

Mar. 9, 1982 [JP] Japan ..... 57-37064

[51] Int. Cl.[3] ..... B66B 5/02

[52] U.S. Cl. ..... 187/29 R; 318/798; 318/803; 318/805; 363/35; 363/37

[58] Field of Search ..... 187/29, 29 R; 318/786, 318/798, 800, 801, 802, 803, 805, 806, 807, 808, 809, 810, 814, 817; 363/51, 35, 37; 307/109; 320/1; 361/15

[56] References Cited

U.S. PATENT DOCUMENTS

| | | | |
|---|---|---|---|
| 3,939,387 | 2/1976 | Maeda | 318/805 |
| 4,307,442 | 12/1981 | Yano et al. | 363/51 |
| 4,328,454 | 5/1982 | Okuyama et al. | 318/803 |
| 4,437,050 | 3/1984 | Overzet | 318/803 X |

FOREIGN PATENT DOCUMENTS

| | | | |
|---|---|---|---|
| 2103437 | 2/1983 | United Kingdom | 187/29 R |
| 2106730 | 4/1983 | United Kingdom | 187/29 R |

*Primary Examiner*—J.V. Truhe
*Assistant Examiner*—Paul Shik Luen Ip
*Attorney, Agent, or Firm*—Sughrue, Mion, Zinn, Macpeak and Seas

[57] ABSTRACT

Disclosed is an AC elevator control apparatus, in which AC power supplied from an AC source is rectified by a converter and a smoothing capacitor into DC power, the DC power being in turn converted by an inverter into variable-frequency AC power by which an AC electric motor is driven to operate an elevator cage. The apparatus includes a rectifying circuit connected to the AC source, a resistor connected between the rectifying circuit and the smoothing capacitor, a charging time measuring circuit for measuring the time from turn-on of the AC source until the completion of charging the smoothing capacitor, and a control circuit for producing an abnormality detection signal when it is detected that the output of the charging time measuring circuit is shorter than a predetermined value, whereby the reduction in capacitance of the capacitor, and hence the expiration of the lifetime of the same, can be evaluated in advance.

10 Claims, 4 Drawing Figures

AC ELEVATOR CONTROL APPARATUS

BACKGROUND OF THE INVENTION

The present invention relates to an improvement in an apparatus for controlling an elevator driven by an AC electric motor.

There is known an elevator control apparatus, in which an induction motor is employed for driving an elevator cage and wherein a variable-voltage and variable-frequency AC power converted by an inverter is supplied to the motor to control the speed thereof. FIG. 1 is a block diagram of such an elevator control apparatus.

In FIG. 1, reference numeral 1 denotes a power switch for turning on/off a three-phase AC source R, S and T; 2 denotes a converter connected to the power switch 1 and constituted by thyristors for rectifying the source voltage into a DC voltage; 3 denotes a smoothing capacitor connected to the DC side of the converter 2; 4 denotes a known inverter connected to the smoothing capacitor 3 and constituted by transistors and diodes for converting the DC power into AC power having a desired voltage and frequency. Reference numeral 5 denotes a control circuit for controlling the converter 2 and the inverter 4; 6 denotes a three-phase induction motor connected to the AC side of the inverter 4 for hoisting the cage; 7 denotes a hoist driving sheave driven by the motor 6; 8 denotes a main rope wound around the sheave 7; and 9 and 10 denote an elevator cage and a balance weight, respectively, connected to opposite ends of the main rope 8.

The three-phase AC power is thus converted by the converter 2 and the smoothing capacitor 3 into DC power which is in turn supplied to the inverter 4. The inverter 4 converts the supplied DC power into variable-voltage and variable frequency AC power which is in turn supplied to the motor 6. This operation is controlled by the control circuit 5. Thus, the motor 6 is driven and the cage is caused to move upward/downward.

However, since a surge current flows into the capacitor 3 upon the turn-on of the power switch 1, it is necessary to control the current to limit the same to a value below the rated current value of the smoothing capacitor 3 and the converter 2. For this purpose, the control circuit 5 should be arranged so as to control the firing angle of the thyristors in the converter 2.

For the smoothing capacitor 3, an electrolytic capacitor having a large capacitance is usually employed. Generally, the lifetime of such an electrolytic capacitor is shorter than that of the elevator, which is about 20–30 years, while this of course depends on the use conditions. In this case, therefore, the reduction in capacitance of the capacitor affects elevator control.

SUMMARY OF THE INVENTION

The present invention is intended to eliminate the above-mentioned disadvantage in the conventional apparatus, and has an object of providing an AC elevator control apparatus, in which upon turning on a power source, the smoothing capacitor is charged through a resistor and a signal is generated when the time required for charging is shorter than a predetermined value, so as to detect the reduction in capacitance of the smoothing capacitor, to thereby anticipate and prevent a fault from occurring.

To attain this object, according to an aspect of the present invention, an AC elevator control apparatus, in which AC power supplied from an AC source is rectified by a converter and a smoothing capacitor into DC power, which is in turn converted by an inverter into variable-frequency AC power so as to operate an elevator cage, comprises a rectifying circuit connected to the AC source, a resistor connected between the rectifying circuit and the smoothing capacitor, a charging time measuring circuit for measuring the time from turn-on of the AC source until the completion of the charging of the smoothing capacitor, and a control circuit for producing a detection signal when it is detected that an output of the charging time measuring circuit is shorter than a predetermined value.

DETAILED DESCRIPTION OF THE PREFERRED EMBODIMENTS

Figure 1:
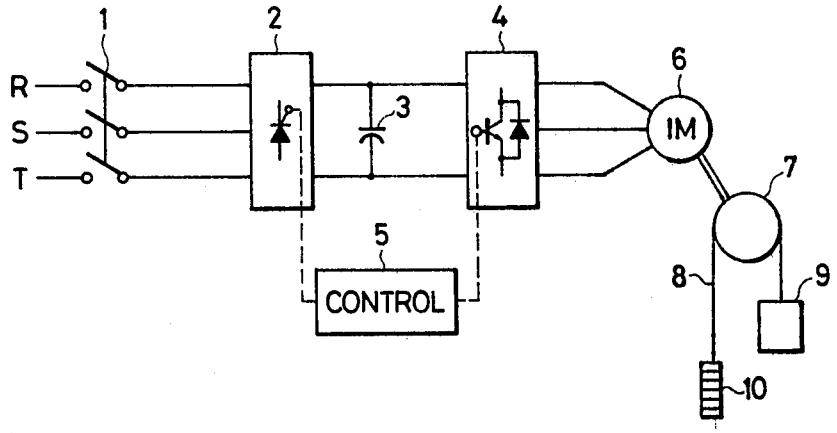
FIG. 1 PRIOR ART
FIG. 1 is a block diagram illustrating a conventional AC elevator control apparatus.
Figure 2:
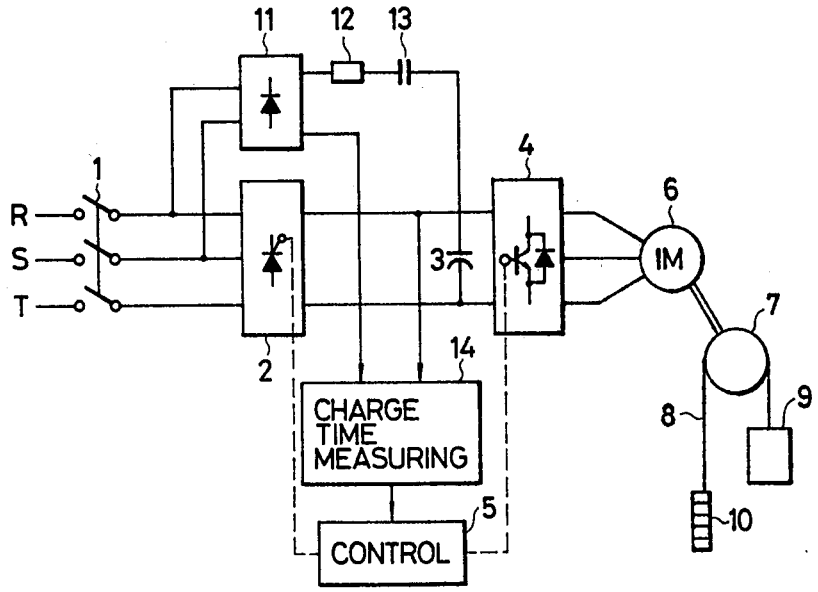
FIG. 2 is a block diagram of an embodiment of the AC elevator control apparatus according to the present invention.

Referring to FIG. 2, one embodiment of the present invention will be described hereunder. In FIG. 2, the same reference numerals as used in FIG. 1 indicate the same components.

In FIG. 2, reference numeral 11 denotes a rectifying circuit connected to the power switch 1 and constituted by a known diode bridge or the like, with its DC side connected at one terminal to an end of the smoothing capacitor 3. A resistor 12 is connected to the other terminal of the DC side of the rectifying circuit 11, and a contact 13 of an electromagnetic contactor is connected between the resistor 12 and the other end of the capacitor 3. The contactor is closed for a predetermined period of time starting from the turn-on of the power switch 1. A charge time measuring circuit 14 is connected to opposite ends of the smoothing capacitor 3 for measuring the charging time of the capacitor 3 and producing an output corresponding to the measured charging time to a control circuit 5. The other components are the same as those described with respect to FIG. 1. Devices such as those disclosed in U.S. application Ser. No. 433,535 may be used for the converter 2 and inverter 4.

The operation of this embodiment will now be described.

When the power switch 1 is turned on, the contact 13 is closed for a predetermined period of time (until the smoothing capacitor has been charged). Thus, the smoothing capacitor 3 begins to be charged through the resistor 12 and the charge voltage across the capacitor 3 increases in accordance with a time constant determined by the electrostatic capacitance value of the smoothing capacitor 3 and the resistance value of the resistor 12. During this period, the control circuit 5 outputs no firing command to the thyristors of the converter 2 and no operation command to the inverter 4.

On the other hand, the charging time measuring circuit 14 measures the charging time of the smoothing capacitor 3. The control circuit 5 monitors the charging time so as to produce an abnormality detection signal when it detects that the charging time is shorter than a predetermined value. By using this detection signal, it is possible to stop the normal operation of the cage 9 and/or to produce an alarm so as to enable proper action to be taken to replace the smoothing capacitor prior to the occurrence of a fault such that the normal operation of the cage becomes impossible.

Another embodiment of the present invention will be described by referring to FIG. 3, which illustrates the circuitry of the invention in more detail.

Figure 3:
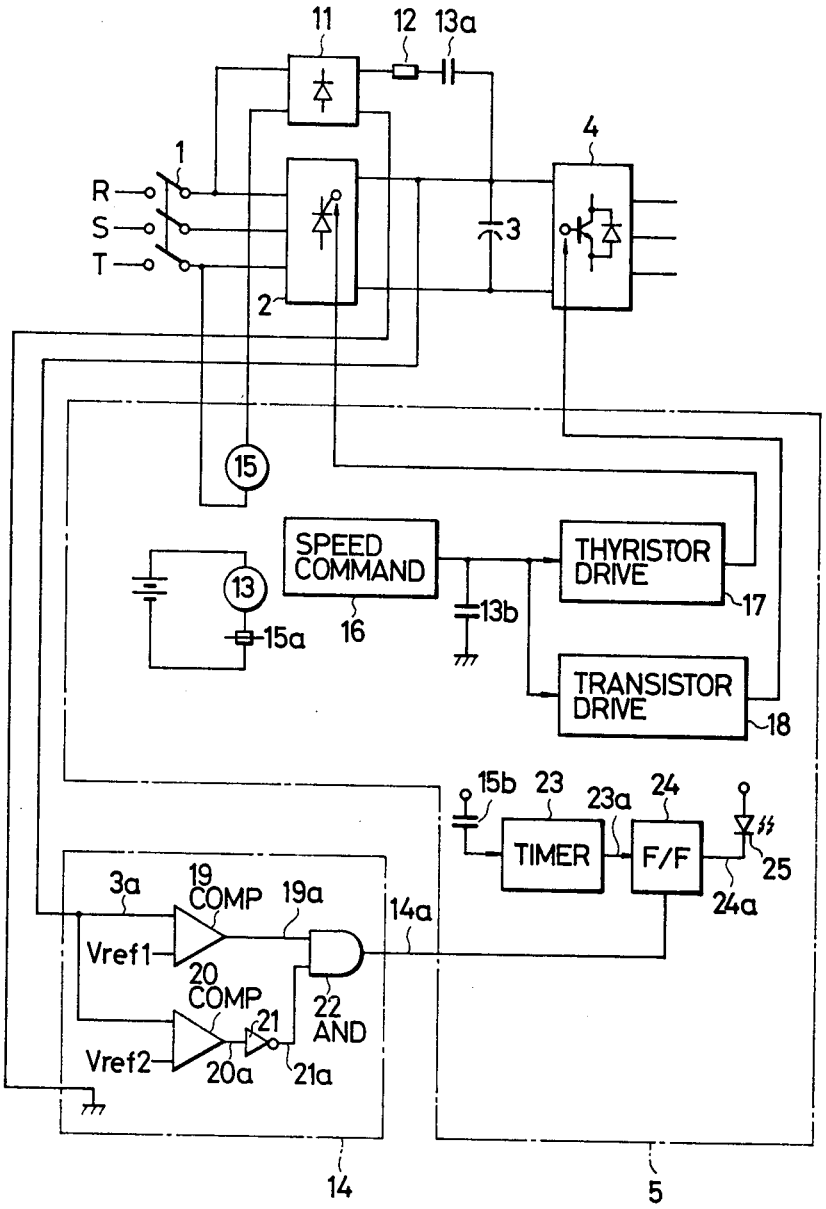
FIG. 3 is a block diagram of another embodiment of the control apparatus according to the present invention, in which the electrical circuit is illustrated in detail.

In FIG. 3, the same reference numerals denote the same or similar components in FIG. 2. A relay 15 is energized when the power switch 1 is turned on, so as to open its contact 15*a* and close its contact 15*b*. A relay 13 constituted by, for example, an off-delay timer having a mechanical timing mechanism is also provided, so as to open its contacts 13*a* and 13*b* after a predetermined period of time has elasped from the opening of the contact 15*a*. This predetermined period of time is set to a value which is sufficient for a normal capacitor 3 to be fully charged. While the relay contact 13*b* is in its closed state, the output of a speed command circuit 16 is prevented from reaching thyristor driving circuit 17 as well as transistor driving circuit 18. Thus, the converter 2 and inverter 4 are not supplied with operation commands, so as to be in a non-actuated state during the charging of the capacitor 3. The speed command circuit 16, the thyristor driving circuit 17 and the transistor driving circuit 18 may comprise any of a number of well-known conventional devices. Alternatively, they may be control circuits as shown in FIG. 5 of application Ser. No. 433,535 filed Oct. 8, 1982 of the same assignee of the present application.

Figure 4:
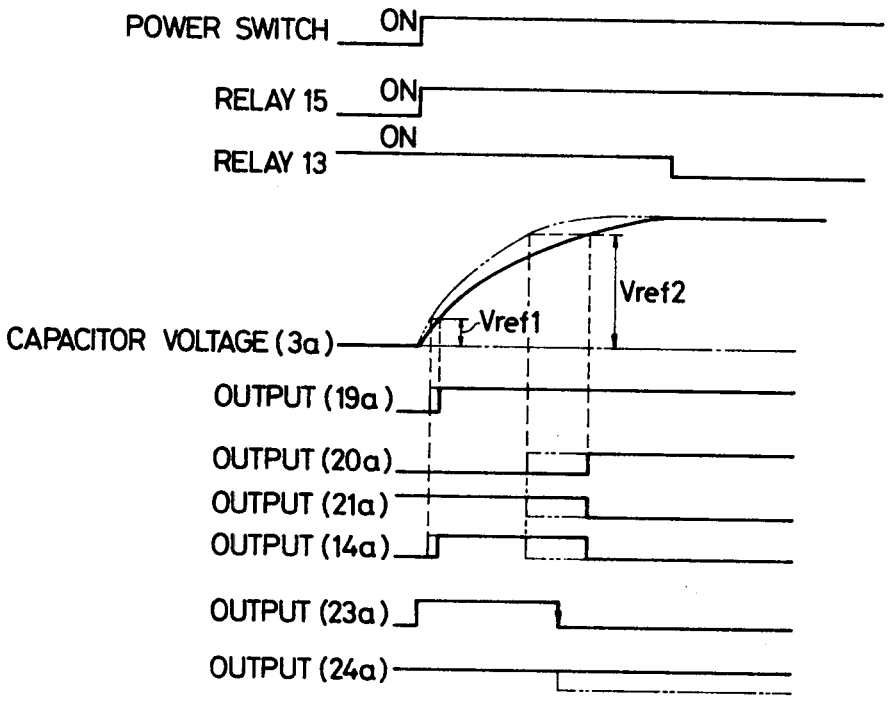
FIG. 4 is a timing chart explaining the operation of the control apparatus shown in FIG. 3.

The charging time measuring circuit 14 includes two comparators 19 and 20 and two logic elements, an inverter element 21 and an AND gate 22. The output 19*a* of the comparator 19 assumes a high level when a voltage signal 3*a* representing the voltage across the capacitor 3 reaches a reference voltage $V_{ref}$1. The output 20*a* of the comparator 20 assumes a high level when the voltage signal 3*a* reaches a reference voltage $V_{ref}$2. An inverter element 21 reverses the output 20*a* of the comparator 20 to produce an output 21*a*. The AND gate 22 produces an output 14*a* of a high level when both signals 19*a* and 21*a* are in their high state. A timer circuit 23, which may be constituted by a digital timer employing a CR time constant circuit and a digital counter, produces an output 23*a* having a high level for only a preset period of time. A flip-flop 24 maintains its output 24*a* at the high level when the input signal 23*a* rises from low to high level while the other input 14*a* is at the high level (FIG. 4). On the other hand, the output 24*a* assumes a low level when the input 23*a* falls to the low level from the high level while the other input 14*a* is at the high level.

As shown in FIG. 4, while the capacitor voltage signal 3*a* is a value between the two reference voltages $V_{ref}$1 and $V_{ref}$2, each of the signals 19*a* and 21*a* is of a high level and the output signal 14*a* of the charging time measuring circuit 14 is also at a high level. The timer circuit 23 is set such that it produces an output 23*a* for a predetermined period of time which is shorter than the time required for a normal capacitor 3 to be charged from $V_{ref}$1 to $V_{ref}$2. Accordingly, so long as the lifetime of the capacitor 3 has not yet expired and operates in its normal state, the signal 23*a* will assume a low level before either of the signals 21*a* and 14*a* assumes a low level. Therefore, the output 24*a* of the flip-flop 24 will be maintained at a high level as it was, and hence as abnormality indication lamp 25 constituted by a light emitting diode will not be lit.

On the other hand, if the capacitor 3 is deteriorated so that the capacitance thereof is reduced, the signal 3*a* assumes the level indicated along the chain dotted curve shown in FIG. 4, and therefore the charging time becomes shorter. Accordingly, each of the output signals 19*a*, 20*a* and 14*a* will change its level from low to high or vice versa earlier as shown by chain-dotted lines also shown in FIG. 4, Thus, the signal 14*a* will drop to the low level before the signal 23*a* changes to the low level. That is, the signal 23*a* will fall from high to low levels while the signal 14*a* assumes its low level, whereby the abnormality indication lamp 25 is lit.

As described above, according to the present invention, when the power is turned on, a smoothing capacitor is charged through a resistor to measure the charging time, so that a signal may be generated when it is detected that the charging time becomes shorter than a predetermined time. Accordingly, it becomes unnecessary to control the converter to suppress the charging current, and possible to evaluate the reduction in capacitance of the smoothing capacitor and therefore the expiration of the lifetime of the smoothing capacitor in advance.

What is claimed is:

1. In an AC elevator control apparatus wherein AC power supplied from an AC source is rectified by a converter and a smoothing capacitor into DC power, the DC power being in turn converted by an inverter into variable-frequency AC power by which an AC electric motor is driven to operate an operator cage, the improvement comprising:

a rectifying circuit connected to said AC source;

a resistor connected between an output side of said rectifying circuit and said smoothing capacitor;

charging time measuring means for measuring the time from turn-on of said AC source until the completion of charging of said smoothing capacitor; and a control circuit for producing an abnormality detection signal when it is detected that an output of said charging time measuring means is shorter than a predetemined value.

2. An elevator control apparatus according to claim 1, comprising a contact provided in a circuit from the output side of said rectifying circuit through said resistor to said smoothing capacitor, said contact being arranged so as to be closed for only a predetermined period of time from the initiation of supply of said AC power.

3. An elevator control apparatus according to claim 2, said inverter and said converter being operationally inhibited during said predetermined period of time.

4. An elevator control apparatus according to claim 3, said converter including firing-controlled semiconductor switching means.

5. An elevator control apparatus according to claim 3, said inverter including diode means and firing-controlled semiconductor switching means.

6. An elevator control apparatus according to claim 4, said control circuit producing a firing command for said switching means of said converter and an operation command for said inverter during times other than said predetermined period of time.

7. In an AC elevator control apparatus wherein AC power supplied from an AC source is rectified by a converter and a smoothing capacitor into DC power, the DC power being in turn converted by an inverter into variable-frequency AC power by which an AC electric motor is driven to operate as elevator cage, the improvement comprising:

a rectifying circuit connected to said AC source;

a resistor connected between an output side of said rectifying circuit and said smoothing capacitor;

means for detecting a shorter than normal charging time of said smoothing capacitor indicative of the degeneration of said smoothing capacitor, and means for indicating said detection.

8. An elevator control apparatus as claimed in claim 7, said detection means including charging time measuring means and timer means operative for a predetermined time after initiation of said AC power.

9. An elevator control apparatus as claimed in claim 8, said detection means comprising first and second comparators having first and second reference voltages at one input thereto and a capacitor voltage at the other input thereto, an inverter following said second comparator, and AND gate means receiving the outputs from said comparator and said inverter.

10. An elevator control apparatus as claimed in claim 9, further including flip-flop means for actuating said indicating means when an output of said AND gate means drops prior to the output of said timer means after the initiation of said AC power, said predetermined time being set shorter than said normal capacitor charging time.

* * * * *